US009222356B2

(12) United States Patent
Hanaoka

(10) Patent No.: US 9,222,356 B2
(45) Date of Patent: Dec. 29, 2015

(54) DRILL BIT EXCHANGE DEVICE FOR SHIELD TUNNELING MACHINE

(75) Inventor: Yasuharu Hanaoka, Osaka (JP)

(73) Assignee: Hitachi Zosen Corporation (JP)

( * ) Notice: Subject to any disclaimer, the term of this patent is extended or adjusted under 35 U.S.C. 154(b) by 0 days.

(21) Appl. No.: 14/347,007

(22) PCT Filed: Aug. 23, 2012

(86) PCT No.: PCT/JP2012/071251

§ 371 (c)(1),
(2), (4) Date: Mar. 25, 2014

(87) PCT Pub. No.: WO2013/047025

PCT Pub. Date: Apr. 4, 2013

(65) Prior Publication Data

US 2014/0217805 A1 Aug. 7, 2014

(30) Foreign Application Priority Data

Sep. 27, 2011 (JP) ..... 2011-210027

(51) Int. Cl.
*E21D 9/11* (2006.01)
*E21D 9/087* (2006.01)
(Continued)

(52) U.S. Cl.
CPC *E21D 9/06* (2013.01); *E21D 9/081* (2013.01); *E21D 9/087* (2013.01); *E21D 9/104* (2013.01); *E21D 9/112* (2013.01)

(58) Field of Classification Search
CPC ..... E21D 9/11; E21D 9/112; E21D 9/081; E21D 9/104
USPC ..... 299/55, 56, 58, 106, 110; 405/144, 147
See application file for complete search history.

(56) References Cited

U.S. PATENT DOCUMENTS 6,347,838 B1 * 2/2002 Mukaidani et al. ..... 299/55
6,382,732 B1 * 5/2002 Tanaka et al. ..... 299/55
(Continued)

FOREIGN PATENT DOCUMENTS

CN 1375620 A 10/2002 ..... E21D 9/10
CN 201747380 U 2/2011 ..... E21D 9/08
(Continued)

OTHER PUBLICATIONS

International Search for International Application PCT/JP2012/071251, Dec. 4, 2012.
(Continued)

*Primary Examiner* — David Bagnell
*Assistant Examiner* — Michael Goodwin
(74) *Attorney, Agent, or Firm* — Kusner & Jaffe

(57) ABSTRACT

A drill bit exchange device for a shield tunneling machine includes: a housing with an aperture; a valve body housed in a chamber of the housing, the valve body being pivotable about a pivot axis ($O_b$) inclined at a predetermined angle with respect to an axis perpendicular to the front of a cutter head; a bit-housing hole formed in the valve body to detachably accommodate a bit; and an exchange seal recess located at the front of the chamber and at a symmetrical position from the aperture with respect to the pivot axis ($O_b$). The valve body is pivoted about the pivot axis ($O_b$) to move the bit, which faces the aperture, to the exchange seal recess, allowing the bit to be removed from the bit-housing hole and exchanged.

10 Claims, 8 Drawing Sheets

(51) Int. Cl.

| | |
|---|---|
| ***E21D 9/06*** | (2006.01) |
| ***E21D 9/10*** | (2006.01) |
| ***E21D 9/08*** | (2006.01) |

(56) References Cited

U.S. PATENT DOCUMENTS

| | | | | |
|---|---|---|---|---|
| 7,040,712 | B2 * | 5/2006 | Sakae et al. | 299/55 |
| 8,523,288 | B2 * | 9/2013 | Hanaoka et al. | 299/56 |
| 8,540,319 | B2 | 9/2013 | Hanaoka | 299/58 |
| 2013/0045055 | A1 * | 2/2013 | Derycke et al. | 405/138 |
| 2014/0357461 | A1 * | 12/2014 | Yokoyama | 483/1 |

FOREIGN PATENT DOCUMENTS

| | | | | |
|---|---|---|---|---|
| CN | 201705361 | U | 1/2012 | E21D 9/08 |
| JP | 11-311090 | | 11/1999 | E21D 9/08 |
| JP | 2000-096987 | | 4/2000 | E21D 9/10 |
| JP | 3139749 | | 12/2000 | E21D 9/08 |
| JP | 2001-129353 | | 5/2001 | B01D 53/56 |
| JP | 2002-276291 | | 9/2002 | E21D 9/08 |
| JP | 2004-211477 | | 7/2004 | E21D 9/087 |
| JP | 2002-147175 | | 5/2005 | E21D 9/08 |
| JP | 2006-348615 | | 12/2006 | E21D 9/087 |
| JP | 2007-169888 | A | 7/2007 | E21D 9/06 |
| JP | 4163965 | | 8/2008 | E21D 9/087 |
| JP | 2011-157683 | | 8/2011 | E21D 9/087 |

OTHER PUBLICATIONS

Chinese Search Report issued in corresponding Chinese Patent Application No. 201280045339.2, dated Aug. 23, 2012.

Office Action received in corresponding Chinese Patent Application No. 201280045339.2, dated Feb. 13, 2015.

Notice of Allowance dated Jun. 23, 2015 in corresponding Korean Patent Application No. 10-2014-7007342.

* cited by examiner

DRILL BIT EXCHANGE DEVICE FOR SHIELD TUNNELING MACHINE

FIELD OF THE INVENTION

The present invention relates to a drill bit exchange device for a shield tunneling machine in which a worn roller bit is exchanged from a working space in a cutter head during drilling.

BACKGROUND OF THE INVENTION

Many structures have been proposed for drill bit exchange devices that exchange worn roller bits during drilling. For example, Patent Literatures 1 and 2 disclose drill bit exchange devices, each including a rotating body having a support hole on the back of a front plate having an opening such that a roller bit is slidably fit into the support hole.

CITATION LIST

Patent Literature

Patent Literature 1: Japanese Patent No. 4163965
Patent Literature 2: Japanese Patent No. 3139749

SUMMARY OF INVENTION

Technical Problem

In the drill bit exchange devices described in Patent Literatures 1 and 2, however, the rotating body has a spherical support surface. This makes it difficult to support a large drilling reaction force on the roller bits. Moreover, this may disadvantageously lead to a complicated structure and a complicated exchanging operation.

An object of the present invention is to provide a drill bit exchange device for a shield tunneling machine that can support a large drilling reaction force with a simple structure and a simple exchanging operation so as to solve the problem.

Solution to Problem

In order to solve the problem, an invention according to a first aspect is a drill bit exchange device for a shield tunneling machine in which a drill bit disposed at the front of a cutter head is exchanged during drilling from a working space formed in the cutter head, the drill bit exchange device including:

- a housing with a tunneling aperture attached to the front of the cutter head so as to expose the drill bit;
- a valve body disposed in a valve-housing chamber that is formed in the housing so as to communicate with the tunneling aperture, the valve body being pivotable about a pivot axis inclined at a predetermined angle with respect to an axis perpendicular to the front of the cutter head;
- a bit-housing hole that is formed in the valve body so as to communicate with the tunneling aperturet, the drill bit being detachably housed in the bit-housing hole; and
- an exchange seal recess disposed at the front of the valve-housing chamber, the exchange seal recess being separated from the tunneling aperture at the pivoting position of the tunneling aperture with respect to the pivot axis,
- wherein the valve body is substantially cylindrical and includes a seal body that is formed along the front outer edge of the valve body so as to seal the tunneling aperture, an opening for the bit-housing hole formed on a part of the seal body, and a drilling recess that is formed by removing the seal body around the opening for the bit housing hole and accommodates the drilling end of the drill bit,
- the drill bit exchange device further includes an exchange seal member that seals a clearance between the housing and the valve body around the exchange seal recess, and
- the valve body is pivoted about the pivot axis so as to move the drill bit in the drilling recess to the exchange seal recess when the drill bit is exchanged, allowing the drill bit to be removed from the bit-housing hole and exchanged.

An invention according to a second aspect in the configuration of the first aspect, wherein the exchange seal member is a tubular seal member that allows an adjustment of a sliding pressure by changing a fluid pressure applied to the hollow part of the seal member.

An invention according to a third aspect in the configuration of the first or second aspect, wherein the drill bit is a roller bit including a disc cutter rotatably supported by a bit support,

- the bit support has a mud discharge passage that penetrates the bit support from the periphery of the disc cutter along the attachment/removal direction of the bit-housing hole,
- a linear mud discharge pipe is connected so as to communicate with the outer surface of the cutter head from the mud discharge passage of the bit support via the working space, and
- a short pipe connectable to and separable from the mud discharge pipe is provided and cutoff valves are respectively provided at the inlet and outlet pipes of the short pipe.

Advantageous Effects of Invention

According to the invention of the first aspect, the valve body with the bit-housing hole formed via the drilling recess is disposed on a part of the seal body extended along the front edge of the substantially cylindrical shape in the valve-housing chamber of the housing such that the valve body can pivot about the pivot axis inclined with respect to the axis perpendicular to the front surface of the cutter head. Thus, only by pivoting the valve body about the pivot axis when the bit is exchanged, the tunneling aperture can be sealed with the seal body while the drill bit whose drilling end is protruded into the drilling recess is displaced to the exchange seal recess surrounded by the exchange seal member. Thus, the worn drill bit is removed along the bit housing hole from the exchange seal recess surrounded by the exchange seal member, a new drill bit is attached into the bit-housing hole, and then the valve body is pivoted to align the new drill bit with the tunneling aperture, allowing the drill bit to be easily exchanged in a short time. Moreover, the simple structure including the valve body with the inclined pivot axis in the housing can achieve high reliability. Since the valve body is substantially cylindrical, a sufficiently larger drilling reaction force than that of a spherical surface can be reliably supported.

According to the invention of the second aspect, the exchange seal member is a tube seal that allows an adjustment of a sliding pressure. This can prevent carried soil or crushed stones at the time of the passage of the drill bit and the drilling recess from causing damage on the exchange seal member by decompressing the exchange seal member during the replacement of bits, leading to higher sealing performance.

According to the invention of the third aspect, the mud discharge pipe is connected so as to linearly extend from the mud discharge passage formed in the bit support. Thus, muddy water containing stones drilled by the roller bit can be smoothly discharged without clogging, achieving effective drilling. Since the cutoff valves are provided at the front and rear of the short pipe, the mud discharge pipe can be removed without leaking muddy water into the working space when the bit is exchanged, allowing the worn roller bit to be easily exchanged.

DETAILED DESCRIPTION OF THE PREFERRED EMBODIMENT

First Embodiment

An embodiment of a shield tunneling machine including a drill bit exchange device according to the present invention will be described below with reference to the accompanying drawings.

(Shield Tunneling Machine)

Figure 10:
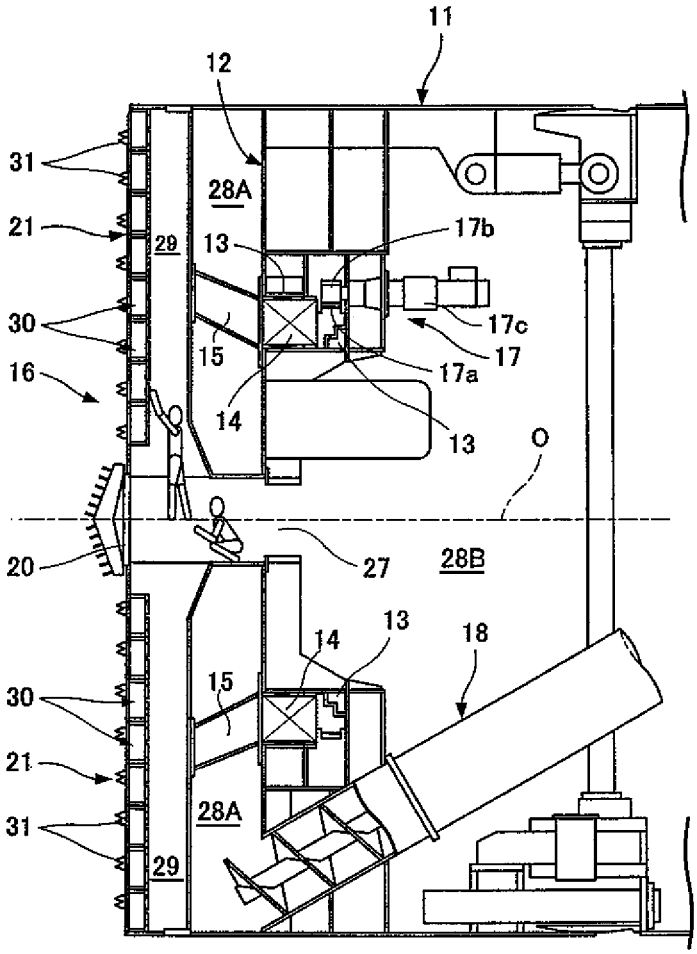
FIG. 10 is a longitudinal section of the shield tunneling machine including the bit exchange unit.

As shown in FIG. 10, a pressure bulkhead 12 is provided at the front of a cylindrical shield body 11. A pressure chamber 28A that keeps a face collapse earth pressure is formed at the front of the pressure bulkhead 12. In the pressure bulkhead 12, a rotating ring body 14 is supported via a rotating bearing 13 so as to rotate about a shield axis O. A circular cutter head 16 is supported by a plurality of support legs 15 that protrude forward from the rotating ring body 14. An air chamber 28B behind the pressure bulkhead 12 includes a cutter driving device 17 that rotates the cutter head 16. The cutter driving device 17 includes a ring gear 17*a* provided on the back of the rotating ring body 14, a plurality of driving pinions 17*b* engaged with the ring gear 17*a*, and rotating devices (hydraulic or electric motors) 17*c* that rotate the respective driving pinions 17*b*. Furthermore, a soil screw conveyor 18 penetrates the pressure bulkhead 12 such that the screw conveyor 18 discharges soil, which has been drilled by the cutter head 16, to the air chamber 28B from the pressure chamber 28A while the pressure chamber 28A keeps a face collapse earth pressure.

(Cutter Head)

Figure 11:
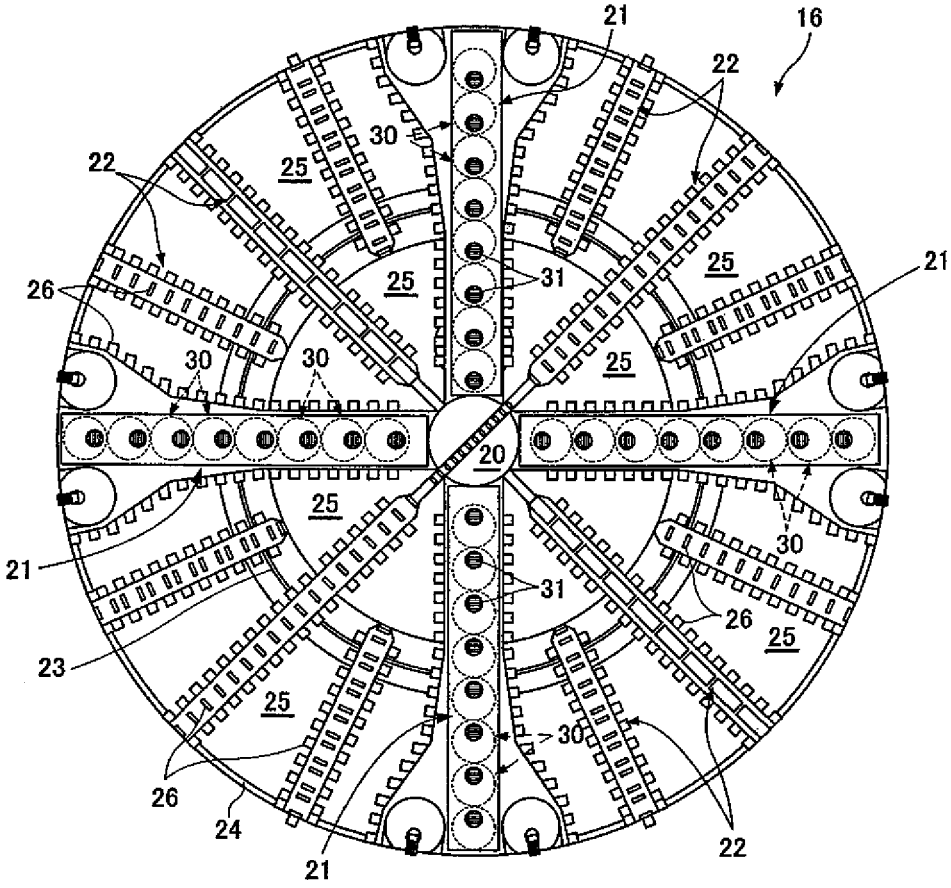
FIG. 11 is a front view showing the cutter head of the shield tunneling machine including the bit exchange unit.

As shown in FIG. 11, the cutter head 16 includes a plurality of main spokes 21 that radially extend from a central member 20 disposed on the shield axis O, a plurality of sub spokes 22 that radially extend between the main spokes 21, and an intermediate ring 23 and an outer ring 24 that are circumferentially provided with respect to the shield axis O so as to connect the main spokes 21 and the sub spokes 22. Moreover, soil inlet ports 25 are formed among the members 21 to 24.

Furthermore, a plurality of bit exchange units (drill bit exchange devices) 30 according to the present invention are provided at the front of the main spoke 21. The bit exchange unit 30 includes a roller bit 31 that is a drill bit to be exchanged. A plurality of fixed bits 26 are provided on the front faces and sides of the central member 20 and the sub spokes 22 and the sides of the main spokes 21.

As shown in FIG. 10, a manhole 27 allowing the passage of a worker is provided near the back of the central member 20. The manhole 27 penetrates the pressure bulkhead 12 so as to allow the passage of a worker from the air chamber 28B. On the back sides of the main spokes 21, a working space 29 is formed so as to allow a worker to enter inside and perform a drill bit exchange operation. The working space 29 communicates with the manhole 27, allowing a worker to come into the working space 29 from the manhole 27. Thus, a worker who comes into the working space 29 from the manhole 27 during drilling can exchange the worn roller bits 31 from the working space 29.

(Bit Exchange Unit)

The bit exchange units 30 are radially disposed at predetermined pitches on the front surface of the main spoke 21. The roller bit 31 is disposed in the bit exchange unit 30. The bit exchange units 30 are all identical in structure.

Figure 5:
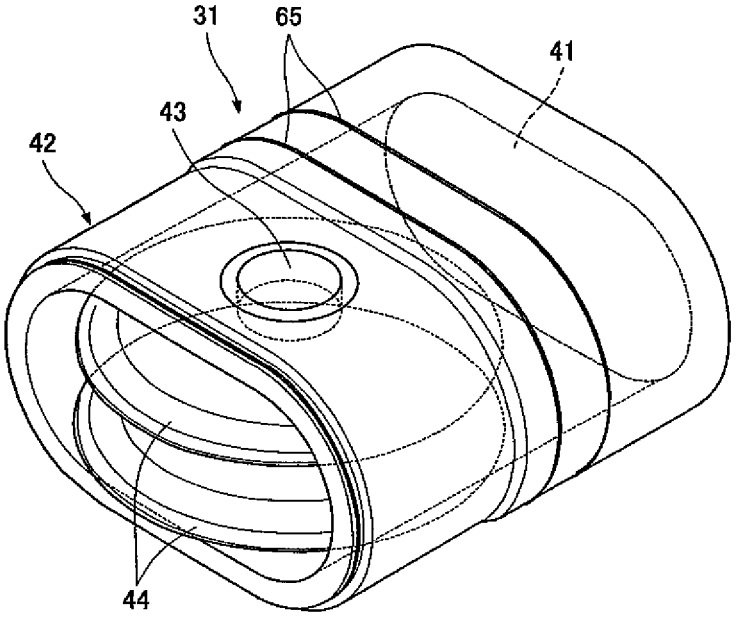
FIG. 5 is a perspective view showing a roller bit and a bit support.

As shown in FIG. 5, the roller bit 31 has a bit support 42 shaped like a long cylinder in cross section. The bit support 42 has a mud discharge passage 41 formed in the longitudinal direction. A double disc cutter 44 is rotatably supported at the front of the bit support 42 via a support shaft 43 extended along the minor axis of the bit support 42.

As shown in FIGS. 1 to 4, the bit exchange unit 30 includes a housing 33 that is attached to the cut portion of a front plate 32 of the main spoke 21. The housing 33 has a tunneling aperture 34 where the roller bit 31 is exposed. Furthermore, a valve-housing chamber 36 is formed in the housing 33. The valve-housing chamber 36 is caused to communicate with the tunneling aperture 34. A valve body 35 that holds the roller bit 31 is pivotally stored in the valve-housing chamber 36 in a tilted position.

Figure 4:
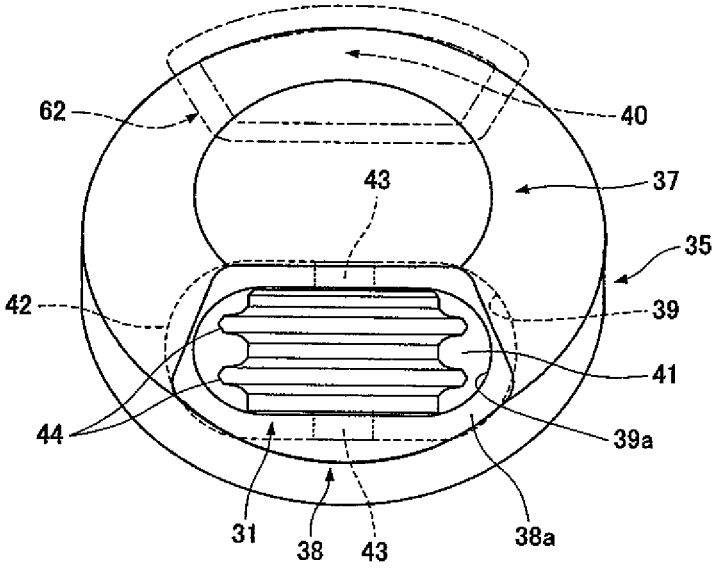
FIG. 4 is a front view of the valve body.

The valve body 35 is substantially cylindrical. A seal body 37 that can seal the tunneling aperture 34 is circumferentially formed on the front outer edge of the valve body 35. For example, the seal body 37 is formed like a trapezoid in cross section such that the edge of the seal body 37 is chamfered on a plane inclined at a predetermined angle (e.g., $\alpha°$, which will be described later) with respect to a pivot axis Ob that is the axis of the cylindrical shape. The seal body 37 has a drilling recess 38 that is formed by partially cutting the seal body 37. The drilling recess 38 has a bit-housing hole 39 that removably accommodates the roller bit 31. As shown in FIG. 4, the bottom of the drilling recess 38 is formed on a removal plane 38*a* where the outer edge of the opening of the bit-housing hole 39 is inclined at the predetermined angle ($\alpha°$, which will be described later) with respect to the pivot axis Ob. A drilling space 38*b* allowing the protrusion of the drilling end of the disc cutter 44 is formed between the removal plane 38*a* and the pivoting path of the top of the seal body 37.

The valve-housing chamber 36 is substantially cylindrical so as to pivotally accommodate the valve body 35. The axis (the pivot axis Ob of the valve body 35) of the valve-housing chamber 36 is inclined at the angle $\alpha°$ such that the removal plane 38*a* on the tunneling aperture 34 is substantially flush with the front surface of the housing 33. Moreover, the back side of the housing 33 is removed along an inclined plane that is perpendicular to the pivot axis Ob. The valve-housing chamber 36 is opened on the inclined plane so as to face the working space 29.

The front of the valve-housing chamber 36 is shaped like a truncated cone so as to guide the seal body 37. The lower part of the valve-housing chamber 36 is caused to communicate with the tunneling aperture 34 that is elliptically formed like the bit support 42 along the tangential direction of the pivot axis Ob. Moreover, an exchange seal recess 40 is formed at a 180° symmetrical position about the pivot axis Ob of the tunneling aperture 34. The exchange seal recess 40 coincides with the drilling recess 38 when the bit is exchanged. The exchange seal recess 40 includes a second seal member 62, which will be described later. The position of the exchange seal recess 40 is not limited to the 180° symmetrical position from the tunneling aperture 34 as long as the exchange seal recess 40 does not overlap the tunneling aperture 34 on the same axis as the tunneling aperture 34 about the pivot axis Ob.

(Valve Pivoting Device)

A valve pivoting device 51 that rotates the valve body 35 about the pivot axis Ob is provided at the rear of the valve-housing chamber 36. The valve pivoting device 51 includes a ring gear 52 that is provided on the outer periphery of the rear end of the valve body 35, a drive shaft 53 that is supported so as to rotate about an axis parallel to the pivot axis Ob at the rear of the housing 33, a driving pinion 54 fixed to the drive shaft 53 so as to mesh with the ring gear 52, and a manual handle 55 that rotates the drive shaft 53.

(Mud Discharge Pipe)

The mud discharge passage 41 of the roller bit 31 is connected to a mud discharge pipe 45 communicating with the pressure chamber 28A on the back side of the main spoke 21. The mud discharge pipe 45 includes a first gate valve (cutoff valve) 46A connected to the bit support 42 via a taper tube, a second gate valve (cutoff valve) 46B connected to the first gate valve 46A via a short pipe 47, and a discharge pipe 48 penetrating a rear plate. The discharge pipe 48 linearly penetrates the working space 29 from the mud discharge passage 41 along an axis Oa and is opened to the pressure chamber 28A. The mud discharge pipe 45 configured thus can smoothly discharge muddy water with crushed stones without clogging.

(Seal Member)

The inner surface of the tunneling aperture 34 of the housing 33 has a first seal member 61 that prevents the entry of muddy water or sediment from a gap between the tunneling aperture 34 and the valve body 35. The first seal member 61 seals the periphery of the drilling recess 38 during drilling. The exchange seal recess 40 has the second seal member (exchange seal member) 62 on the inner surface of the valve-housing chamber 36. The second seal member 62 seals the periphery of the drilling recess 38 having pivoted to the exchange seal recess 40. The second seal member 62 includes a hollow tube seal member connected to a pressure control hole 63 formed in the housing 33. The second seal member 62 is extended or shrunk by an oil pressure or compressed air serving as a compressed fluid discharged into a hollow part from the pressure control hole 63, thereby adjusting a sliding pressure on the valve body 35. With this configuration, when the valve body 35 is pivoted during the replacement of bits, the second seal member 62 is shrunk by decompression, thereby preventing damage during the passage of the edge of the drilling recess 38 and the drilling end of the disc cutter 44. As a matter of course, the first seal member 61 may be a tubular seal member that allows pressurization and decompression.

The outer periphery of the valve body 35 has third seal members 64 in sliding contact with the inner surface of the valve-housing chamber 36. The outer surface of the bit support 42 has fourth seal members 65 in sliding contact with the inner surface of the bit-housing hole 39.

(Roller Bit Exchanging Method)

Referring to FIGS. 1 and 6 to 9, a drill bit exchanging method in the bit exchange unit 30 will be described below.

When the disc cutter 44 of the roller bit 31 is worn after tunneling of a predetermined distance, the cutter head 16 is stopped while the main spoke 21 having the bit exchange units 30 to be exchanged is substantially set in a horizontal position. After that, a worker enters the working space 29 from the manhole 27 to perform a drill bit exchange operation.

Figure 1:
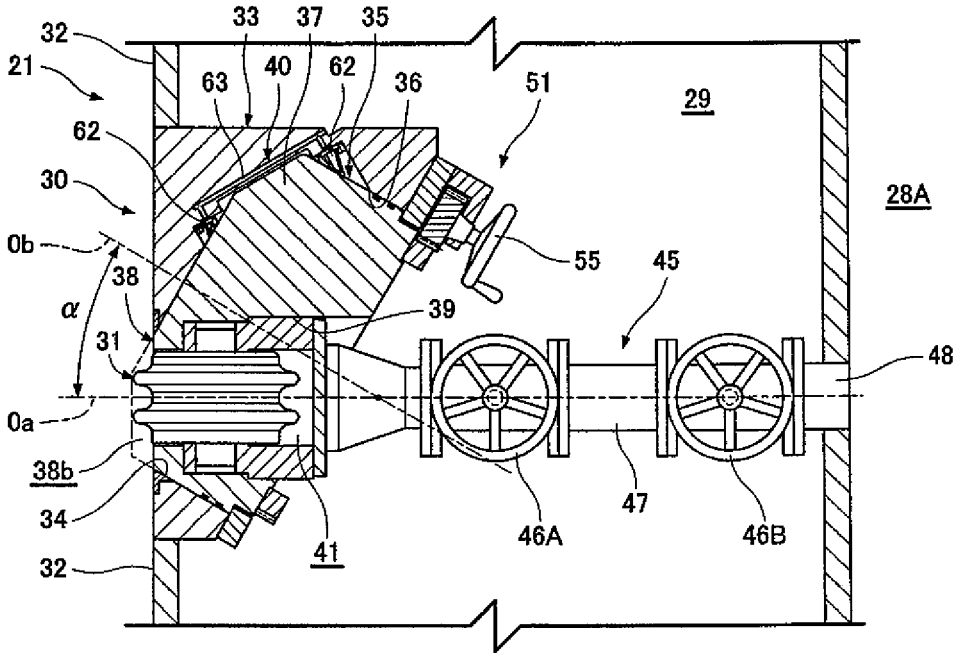
FIG. 1 is a longitudinal section showing a first embodiment of a bit exchange unit in a shield tunneling machine according to the present invention.
Figure 2:
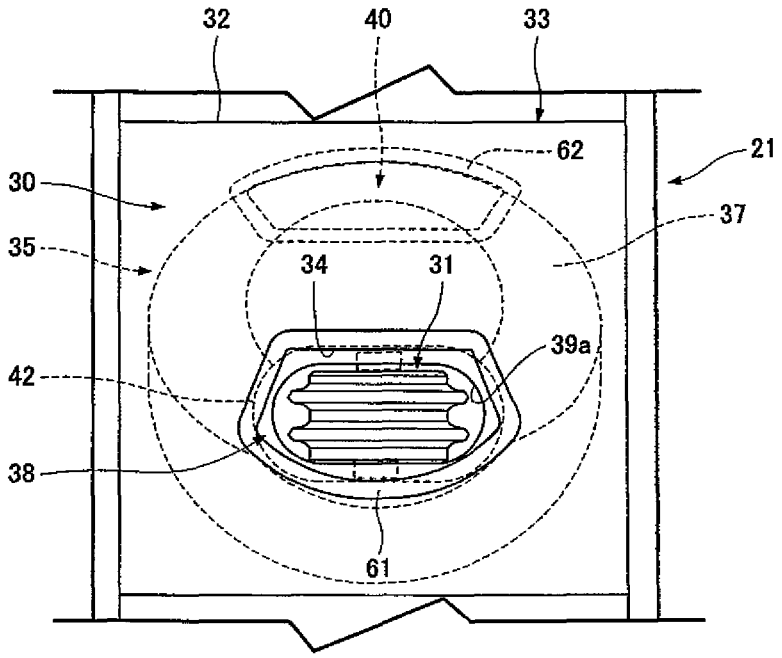
FIG. 2 is a front view showing the tunneling aperture of a cutter head.
Figure 3:
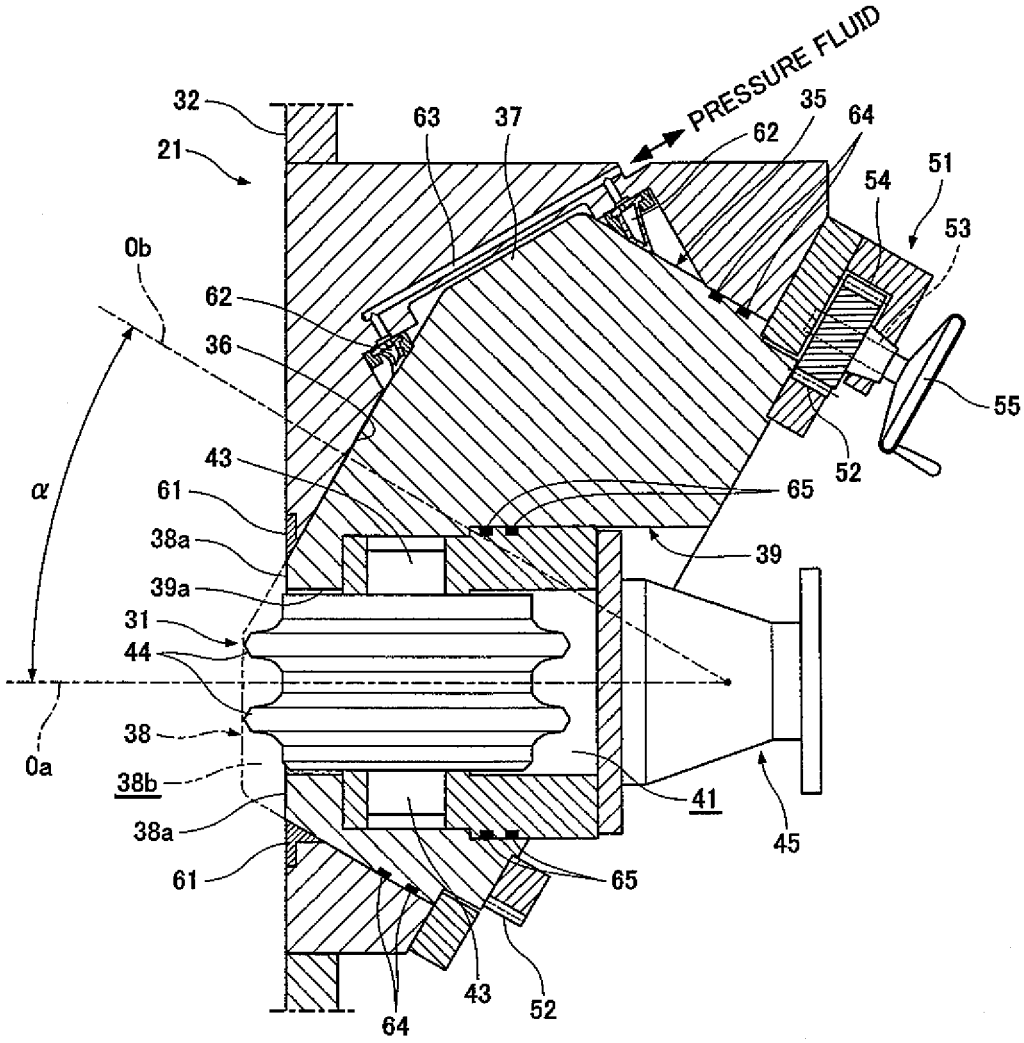
FIG. 3 is a longitudinal section showing an enlarged principle part of a valve body in the bit exchange unit.

A) From a drilled state in FIG. 1, the first gate valve 46A and the second gate valve 46B are first closed, and then the short pipe 47 of the mud discharge pipe 45 is removed.

Figure 6:
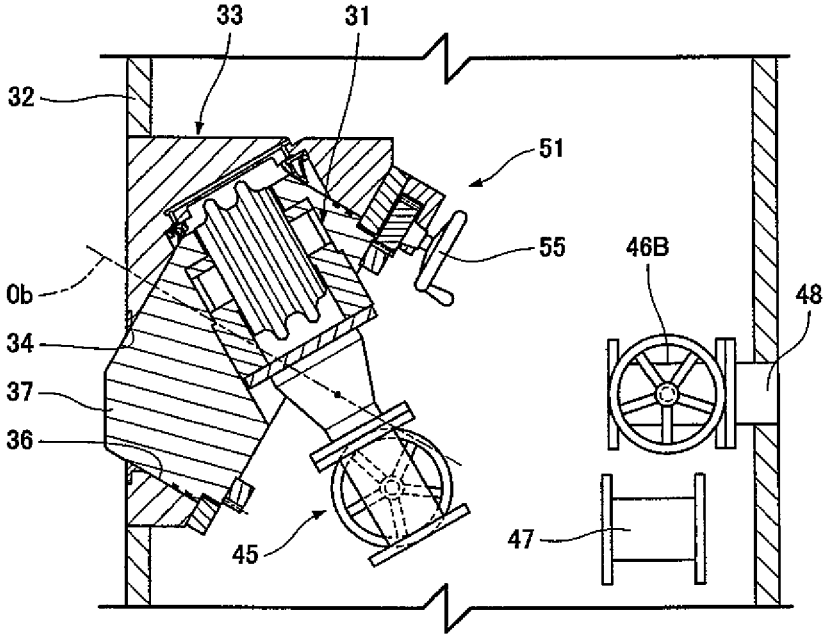
FIG. 6 is a longitudinal section for explaining an exchanging operation in the bit exchange unit.
Figure 7:
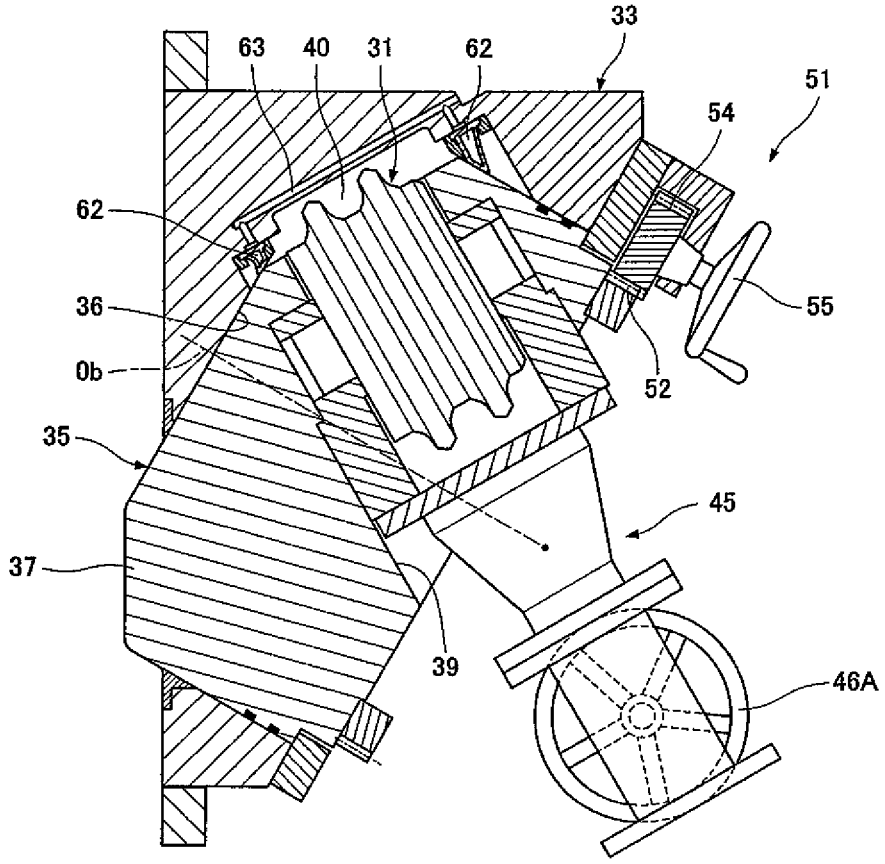
FIG. 7 is a partial enlarged view of FIG. 6.
Figure 8:
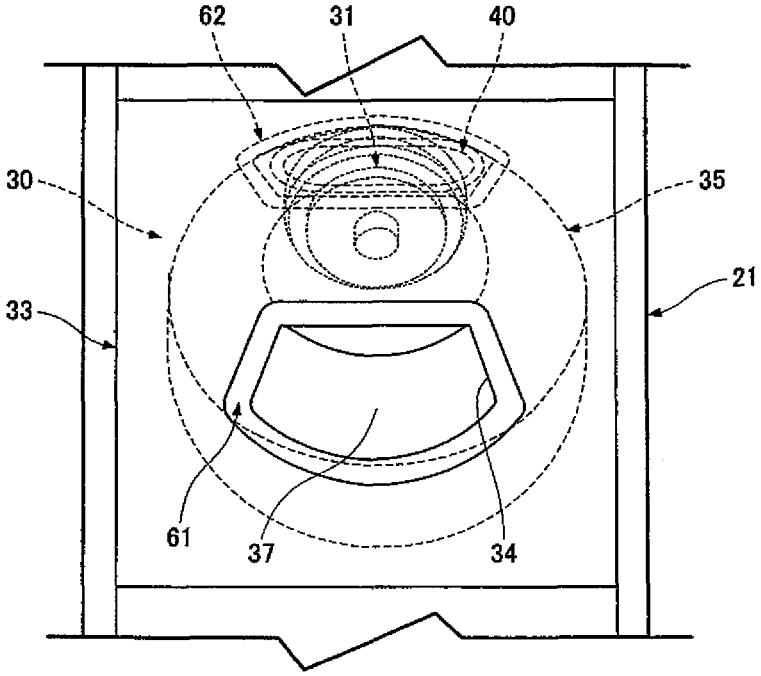
FIG. 8 is a front view of FIG. 6.

B) As shown in FIGS. 6 to 8, the second seal member 62 is decompressed, and then the manual handle of the valve pivoting device 51 is rotated to turn the valve body 35 180° about the pivot axis Ob. This displaces the worn roller bit 31 of the tunneling aperture 34 to the exchange seal recess 40 and seals the tunneling aperture 34 with the seal body 37.

Figure 9:
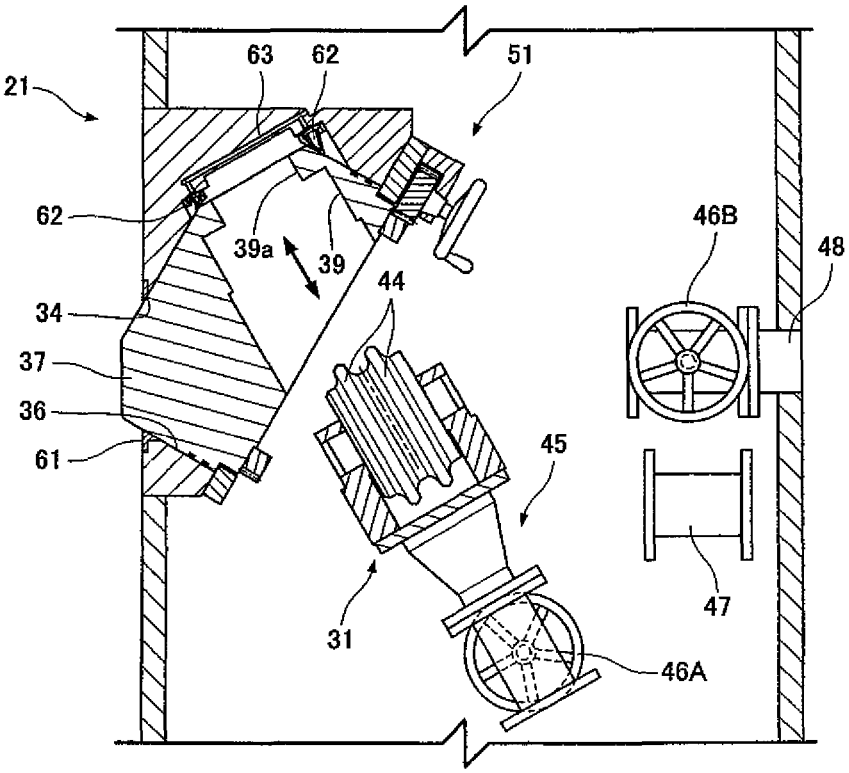
FIG. 9 is a longitudinal section for explaining an exchanging operation in the bit exchange unit.

C) As shown in FIG. 9, the second seal member 62 is pressurized into contact with the periphery of the removal plane 38*a*, and then the roller bit 31 having the worn disc cutter 44 is removed from the bit-housing hole 39 by means of a remover (not shown).

D) A new roller bit 31 is attached into the bit-housing hole 39 by means of the remover.

E) After the second seal member 62 is decompressed, the valve pivoting device 51 is operated to rotate the valve body 35 180° about the pivot axis Ob, so that the new roller bit 31 on the exchange seal recess 40 is pivoted so as to coincide with the tunneling aperture 34. Furthermore, the short pipe 47 is connected between the first gate valve 46A and the second gate valve 46B. The first and second gate valves 46A and 46B are then opened to allow communication in the mud discharge pipe 45.

According to the present embodiment, the valve body 35 having the bit-housing hole 39 opened through the drilling recess 38 is provided on a part of the seal body 37 formed around the front edge of the cylindrical shape. The valve body 35 is housed in the valve-housing chamber 36 of the housing 33 provided at the front of the cutter head such that the valve body 35 is rotatable about the pivot axis Ob inclined with respect to the axis Oa perpendicular to the front surface of the cutter head 16. Thus, only by pivoting the valve body 35 about the pivot axis Ob when the bit is exchanged, the tunneling aperture 34 can be sealed with the seal body 37 while the drilling recess 38 that accommodates the worn roller bit 31 is displaced to the exchange seal recess 40 surrounded by the second seal member 62. The worn roller bit 31 of the exchange seal recess 40 is removed from the bit-housing hole 39 and then a new roller bit 31 is attached into the bit-housing hole 39. After that, the valve body 35 is pivoted to align the new roller bit 31 with the tunneling aperture 34. The worn roller bit 31 can be easily replaced with the new roller bit 31 in a short time only by pivoting the valve body 35.

Furthermore, high reliability can be obtained with a simple structure including the housing 33 accommodating the valve body 35. Since the valve body 35 is cylindrical, a sufficiently larger drilling reaction force than that of a sphere can be reliably supported via the valve body 35 and the housing 33.

Since the second seal member 62 is a tube seal that allows an adjustment of a sliding pressure, the second seal member 62 is decompressed during the passage of the roller bit 31, which comes into and goes out of the exchange seal recess 40 during replacement, and the drilling recess 38. This can prevent carried soil or crushed stones from causing damage on the second seal member 62, leading to higher sealing performance.

Moreover, the mud discharge pipe 45 is connected so as to linearly extend from the mud discharge passage 41 of the bit support 42. Thus, muddy water containing stones drilled by the roller bit 31 can be smoothly discharged to the pressure chamber 28A without clogging, achieving effective drilling. The mud discharge pipe 45 includes the first and second gate valves 46A and 46B at the front and rear of the short pipe 47 to be removed when the bit is exchanged. The short pipe 47 is removed with the closed first and second gate valves 46A and 46B when the bit is exchanged. Thus, the mud discharge pipe 45 can be removed without leaking muddy water into the working space 29, allowing the worn roller bit 31 to be easily exchanged in a short time.

Having described the invention, the following is claimed:

1. A drill bit exchange device for a shield tunneling machine in which a drill bit disposed at a front of a cutter head is exchanged during drilling from a working space formed in the cutter head, the drill bit exchange device comprising:

a housing attached to the front of the cutter head, the housing having a tunneling aperture extending through a front surface of the housing wherein the drill bit may selectively extend through the tunneling aperture;

a valve body disposed in a valve-housing chamber that is formed in the housing so as to communicate with the tunneling aperture, the valve body being pivotable about a pivot axis inclined at a predetermined angle with respect to an axis perpendicular to the front surface of the housing;

a bit-housing hole that is formed in the valve body so as to selectively communicate with the tunneling aperture, the drill bit being detachably housed in the bit-housing hole; and an exchange seal recess formed in a front of the valve-housing chamber, the exchange seal recess being separated from the tunneling aperture by a predetermined angle with respect to the pivot axis, wherein the valve body is substantially cylindrical and includes a seal body that is formed along a front outer edge of the valve body so as to seal the tunneling aperture, an opening for the bit-housing hole formed on a part of the seal body, and a portion of the seal body around the opening being contoured to define a drilling recess, wherein a drilling end of the drill bit is received in the drilling recess, wherein the drill bit exchange device further comprises an exchange seal member that seals a clearance between the housing and the valve body around the exchange seal recess, and wherein the valve body is rotatable about the pivot axis so as to move the drill bit in the drilling recess to the exchange seal recess, thereby allowing the drill bit to be removed from the bit-housing hole and exchanged.

2. The drill bit exchange device for a shield tunneling machine according to claim 1, wherein the exchange seal member is a tubular seal member that includes a hollow part fluidly connected to a source of pressurized fluid for adjusting a sliding pressure on the valve body.

3. The drill bit exchange device for a shield tunneling machine according to one of claims 1 and 2, wherein the drill bit is a roller bit that includes a disc cutter rotatably supported by a bit support, the bit support having a mud discharge passage extending there through, wherein the mud discharge passage surrounds a periphery of the disc cutter, and the mud discharge passage aligns with an attachment/removal direction of the bit-housing hole of the valve body when the roller bit is disposed in the bit-housing hole of the valve body, and wherein the drill bit exchange device includes a linear mud discharge pipe for providing communication between the mud discharge passage of the bit support and a pressure chamber of the cutter head, the linear mud discharge pipe including:

a discharge pipe having one end communicating with the pressure chamber;

a short pipe separable from the mud discharge pipe and cutoff valves connectable to inlet and outlet ends of the short pipe for isolating the bit support from the short pipe and for isolating the short pipe from the discharge pipe.

4. The drill bit exchange device for a shield tunneling machine according to claim 1, wherein the cutter head includes a front plate and the front surface of the housing is generally coplanar with the front plate of the cutter head.

5. The drill bit exchange device for a shield tunneling machine according to claim 1, further comprising a discharge pipe for conveying material from the cutter head, wherein the tunneling aperture of the housing, the bit-housing hole of the valve body and the discharge pipe are aligned along an axis when the valve body is in a position such that the drill bit extends through the tunneling aperture, and wherein the bit-housing hole is inclined relative to the axis when the bit-housing hole aligns with the exchange seal recess of the housing.

6. A drill bit exchange device for a shield tunneling machine, the drill bit exchange device disposed at a front of a cutter head of the machine and dimensioned to receive a drill bit wherein the drill bit is accessible from a working space formed in a rear of the cutter head, the drill bit exchange device comprising:

a housing having a front surface facing the front of the cutter head and a rear surface facing the working space of the cutter head, the rear surface of the housing contoured to define a valve-housing chamber, the housing including:

a tunneling aperture extending through the housing from the front surface of the housing to the valve-housing chamber, and a portion of the rear surface of the housing that defines the valve-housing chamber recessed to define an exchange seal recess wherein the exchange seal recess is spaced from the tunneling aperture;

a valve body rotatably disposed within the valve-housing chamber of the housing, the valve body being rotatable within the valve-housing chamber about an axis that extends in a direction inclined relative to an axis that extends perpendicular to the front surface of the housing, the valve body being substantially cylindrical and having a front edge that is contoured to define a seal body of the valve body and a bit-housing hole that extends through the valve body and that communicates with the seal body, and an exchange seal member disposed in the exchange seal recess of the housing, wherein the seal body of the valve body extends through the tunneling aperture when the valve body is disposed in the valve-housing chamber, and the valve body is rotatable between a first position and a second position, wherein the bit-housing hole is aligned with the tunneling aperture when the valve body is in the first position and the bit-housing hole is aligned with the exchange seal recess when the valve body is in the second position, and wherein a portion of the seal body extending beyond the front surface of the housing defines a drilling recess of the drill bit exchange device.

7. The drill bit exchange device for a shield tunneling machine according to claim 6, wherein the exchange seal member includes a hollow part that is fluidly connected to a source of pressurized fluid and wherein the pressure of the fluid supplied to the hollow part is adjustable for varying the force required to rotate the valve body within the housing.

8. The drill bit exchange device for a shield tunneling machine according to claim 6, further comprising:

a bit support having a mud discharge passage extending therethrough for receiving the drill bit, the bit support dimensioned to be removably disposed in the bit-housing hole of the valve body; and a mud discharge pipe having one connectable to the bit support and another end connected to a pressure chamber of the cutter head, wherein the mud discharge pipe is connected to the bit support and the tunneling aperture of the housing, the mud discharge passage of the bit support and the mud discharge pipe are aligned along an axis when the valve body is in the first position, such that material cut by the drill bit is conveyed in a generally straight path from the front of the cutter head to the pressure chamber of the cutter head and wherein the bit-housing hole is inclined relative to the axis when the valve body is in the second position.

9. The drill bit exchange device for a shield tunneling machine according to claim 8, wherein the mud discharge pipe comprises:

a first cutoff valve connectable to an outlet end of the bit support;

a pipe having one end connectable to the first cut off valve;

a second cutoff valve connectable to an opposite end of the pipe; and a discharge pipe having one end connectable to the second cutoff valve and another end in communication with the pressure chamber of the cutter head.

10. The drill bit exchange device for a shield tunneling machine according to claim 6 wherein the cutter head includes a front plate and the front surface of the housing is generally coplanar with the front plate of the cutter head.

* * * * *